US006843700B2

(12) United States Patent
Glickman

(10) Patent No.: US 6,843,700 B2
(45) **Date of Patent: *Jan. 18, 2005**

(54) ROD AND CONNECTOR TOY CONSTRUCTION SET

(75) Inventor: Joel I. Glickman, Huntingdon Valley, PA (US)

(73) Assignee: Connector Set Limited Partnership, Hatfield, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/752,602

(22) Filed: Jan. 7, 2004

(65) Prior Publication Data

US 2004/0198142 A1 Oct. 7, 2004

Related U.S. Application Data

(62) Division of application No. 10/336,546, filed on Jan. 3, 2003, now Pat. No. 6,676,474.
(60) Provisional application No. 60/367,366, filed on Jan. 7, 2002.

(51) Int. Cl.[7] ..... A63H 33/08
(52) U.S. Cl. ..... 446/127; 446/120; 446/124; 446/126
(58) Field of Search ..... 446/127, 85, 105, 446/107, 116, 120, 121, 122, 124, 125, 126

(56) References Cited

U.S. PATENT DOCUMENTS

| | | | |
|---|---|---|---|
| 2,027,885 | A | 1/1936 | Schwarzbach |
| 2,383,441 | A | 8/1945 | Beile |
| 2,414,716 | A | 1/1947 | Carson |
| 2,633,662 | A | 4/1953 | Nelson |
| 2,752,726 | A | 7/1956 | Calverley |
| 2,833,082 | A | 5/1958 | Carson |
| 3,458,949 | A | 8/1969 | Young |
| 3,570,324 | A | 3/1971 | Conrad |
| 3,747,261 | A | 7/1973 | Salem |
| 3,756,734 | A | 9/1973 | Nicholls |
| 3,891,335 | A | 6/1975 | Feil |
| 4,037,978 | A | 7/1977 | Connelly |

(List continued on next page.)

FOREIGN PATENT DOCUMENTS

| | | |
|---|---|---|
| CH | 0 483 819 | 1/1970 |
| DE | 1 603 295 | 8/1970 |
| DE | 2 410 051 | 9/1975 |
| DE | 2 637 136 | 3/1977 |
| EP | 0 284 311 | 9/1988 |
| FR | 1 475 308 | 2/1967 |
| SE | 0 351 369 | 11/1972 |
| SE | 0 430 950 | 12/1983 |

*Primary Examiner*—Derris H. Banks
*Assistant Examiner*—Ali Abdelwahed
(74) *Attorney, Agent, or Firm*—Schweitzer Cornman Gross & Bondell LLP

(57) ABSTRACT

A rod and connector toy construction set, especially for use by young children. Connector elements, are formed with one or more rod-gripping sockets arranged radially with respect to a hub. The sockets are open at opposite sides, enabling lateral insertion and removal of rods. The connector elements, which are relatively large for easy handling by small children, are formed of a soft and pliant plastic material, to facilitate assembly and disassembly of rods with the connector elements by small hands. The rods generally are formed of a plastic material harder and stiffer than the connector material to accommodate easy handling of the rods during assembly and disassembly and to provide adequate strength in an assembled structure. The rods include enlarged, generally cylindrical end portions and adjacent neck portions of reduced diameter. The connector sockets include inner portions, configured to receive and closely confine the rod end portions, and outer portions arranged to receive and snuggly grip the rod neck portions, such that rods are held in axial alignment with the connector sockets.

19 Claims, 10 Drawing Sheets

U.S. PATENT DOCUMENTS

| | | | |
|---|---|---|---|
| 4,044,497 | A | 8/1977 | Bettens |
| 4,302,900 | A | 12/1981 | Rayner |
| 4,388,012 | A | 6/1983 | Erickson |
| 4,733,648 | A | 3/1988 | Martin |
| 4,758,195 | A | 7/1988 | Walsh |
| 4,776,719 | A | 10/1988 | Kreider |
| 4,787,191 | A | 11/1988 | Shima |
| 4,847,973 | A | 7/1989 | Lundeen |
| 5,030,103 | A | 7/1991 | Buist et al. |
| 5,049,105 | A | 9/1991 | Glickman |
| 5,061,219 | A | 10/1991 | Glickman |
| 5,238,438 | A | 8/1993 | Glickman |
| 5,350,331 | A | 9/1994 | Glickman |
| 5,368,514 | A | 11/1994 | Glickman et al. |
| 5,605,486 | A | 2/1997 | Zheng |
| 5,733,168 | A | 3/1998 | Poulsen et al. |
| 5,853,313 | A | 12/1998 | Zheng |
| 6,089,941 | A | 7/2000 | Glickman et al. |
| 6,280,282 | B1 | 8/2001 | Puchalski |
| 6,491,563 | B1 | 12/2002 | Bailey |
| 6,676,474 | B2 * | 1/2004 | Glickman ..... 446/126 |

* cited by examiner

FIG. 3
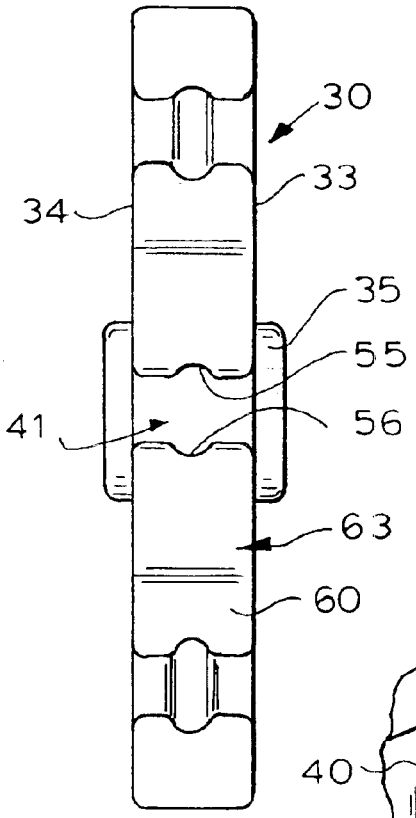
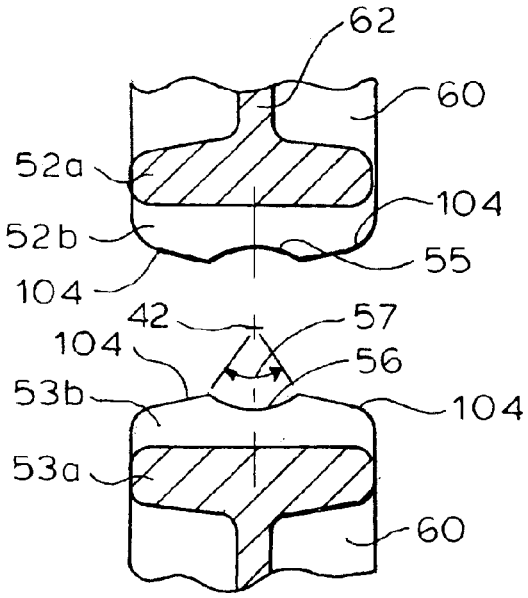
FIG. 4
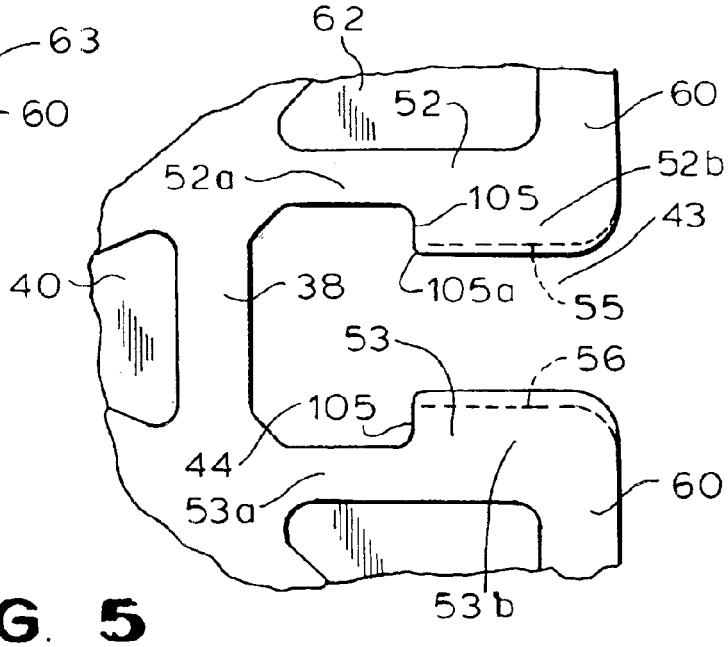
FIG. 5

FIG. 6
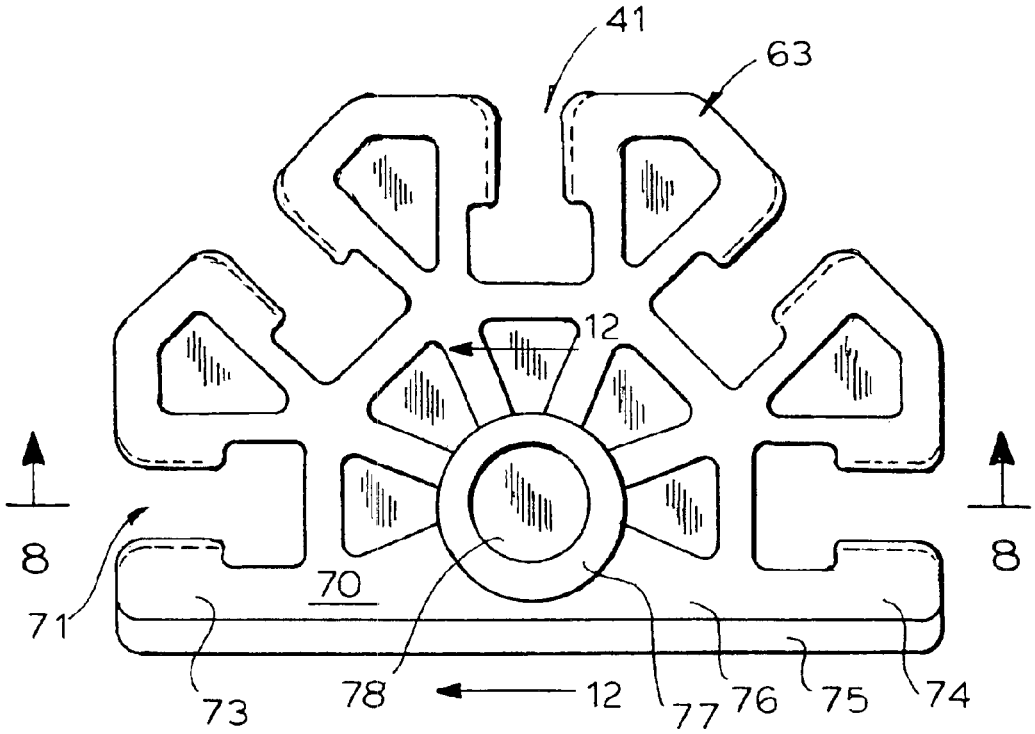
FIG. 7
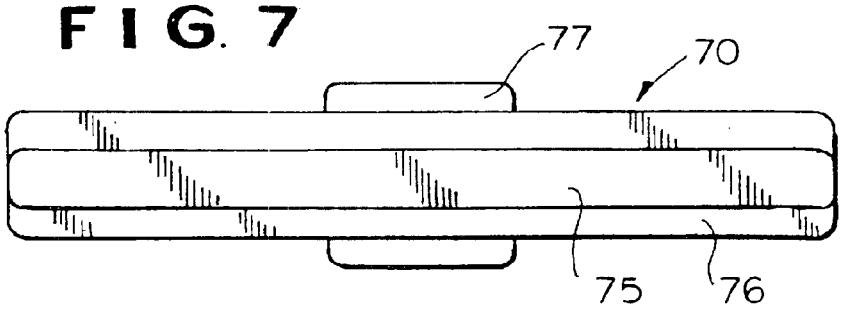
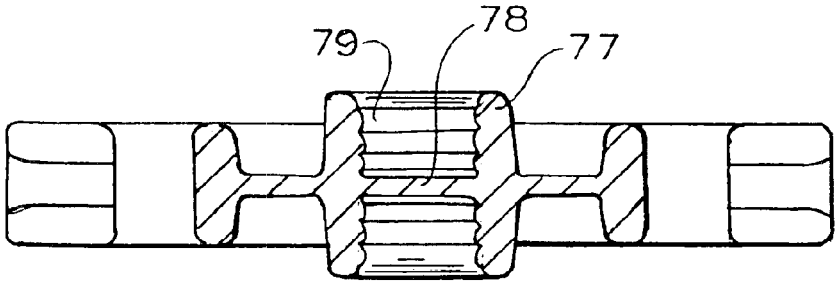
FIG. 8

FIG. 9
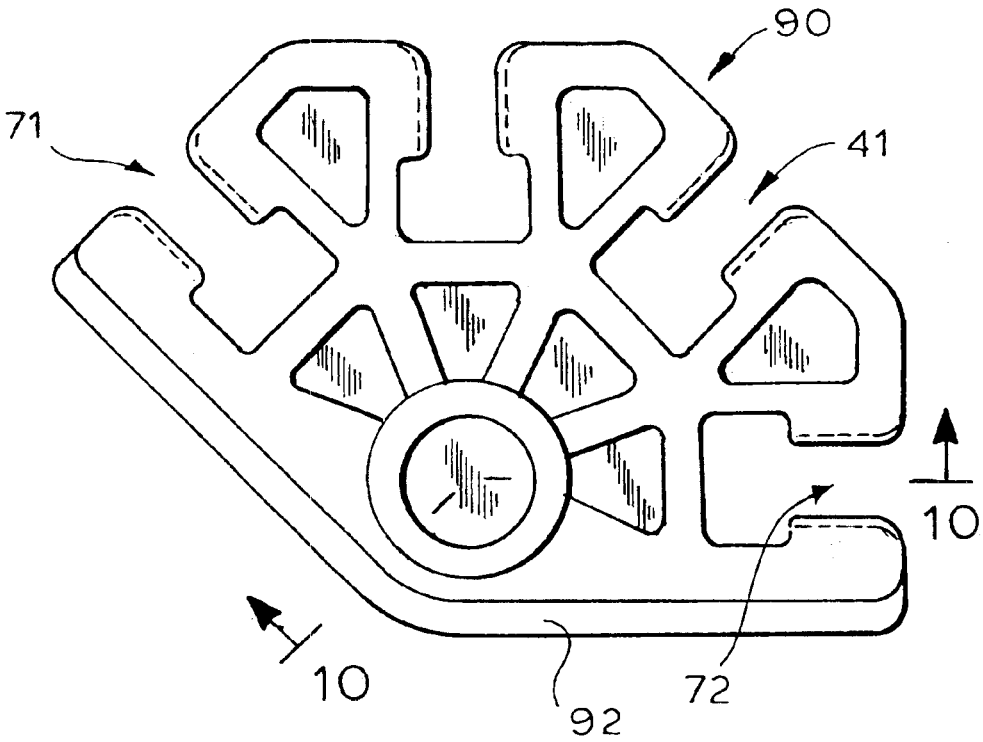
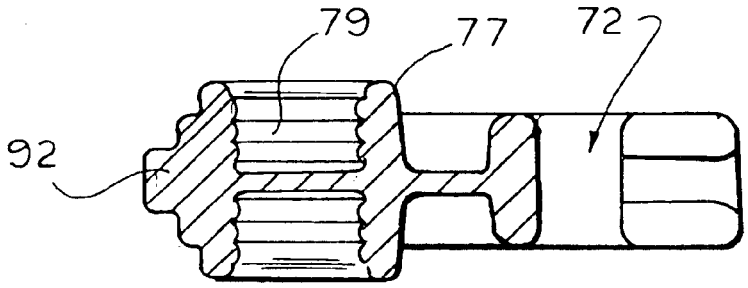
FIG. 10

ROD AND CONNECTOR TOY CONSTRUCTION SET

PRIORITY CLAIMED

This application is a division of my application Ser. No. 10/336,546, filed Jan. 3, 2003, now U.S. Pat. No. 6,676,474, and claims the priority of U.S. Provisional application Ser. No. 60/367,366, filed Jan. 7, 2002.

BACKGROUND OF THE INVENTION

The invention relates generally to toy construction sets and more particularly to such construction sets in which the principal building components are comprised of a series of rods and connectors for joining with the rods. A highly popular form of such construction toy sets is marketed under the trademark "K'NEX", by K'NEX Industries, Inc. Certain features of the K'NEX construction toy sets are reflected in earlier U.S. Pat. Nos. 5,061,219, 5,137,486, 5,199,919 and 5,350,331. The K'NEX construction toy sets, although first introduced relatively a few years ago, have become highly popular and commercially very successful. However, notwithstanding the many advantages and many attractive features of the K'NEX construction toys as presently marketed, a certain level of manual dexterity and finger strength is needed in order to take full advantage of the many features offered. This tends to limit the marketability of the existing construction toy sets to children who have developed a reasonable level of manual dexterity

SUMMARY OF THE INVENTION

The present invention is directed to a rod and connector toy construction set which, while incorporating many of the important advantageous features of the existing K'NEX construction toy, is specifically designed and optimized for children of somewhat younger age. To this end, the component elements of the construction toy set are so designed and constructed as to enable young children, with minimal manual dexterity and finger strength, to assemble and disassemble the components and to build various structures and assemblies therewith.

The rod and connector components of the new construction toy set are suitably sized to infant hands such that the individual component parts may be easily gripped and handled by children of ages, say, four and above. For the rod elements, for example, a rod diameter of about ⅜ inch is suitable for gripping and manipulating with small hands. For an advantageous construction toy set of the type contemplated, such rods are provided in various lengths, ranging from around one inch to around nine inches. The principal rod elements of the new construction set are of generally circular cross sectional outline, having end portions and a central body portion of a generally uniform diameter. The end flanges and the central body portion are separated by neck portions of reduced diameter and predetermined length.

The construction set of the invention further includes connector elements arranged to receive and grip the rod elements in fixed orientations, to enable structures to be assembled. To advantage, the connectors include a hub, with one or more open-ended and open-sided rod-engaging sockets oriented radially with respect to the hub. In a typical construction set, connectors may be provided having as few as one or as many as eight such rod-engaging sockets. Where more than one socket is provided, they typically may be arranged at angular intervals of, for example, 45 degrees.

In accordance with one aspect of the invention, the connector elements are formed of a soft and pliant plastic material which is easily flexed in the area of the rod gripping sockets. The sockets extend completely through the connectors, from one side thereof to the other and are open at both sides. The sockets are formed with features for capturing and gripping the flanged ends and neck portions of the rod elements. The arrangement enables the rods to be installed by a lateral snap-in movement which results in the neck portion of the rod being gripped and held in axial alignment with the principal axis of the socket, by means of opposed, concave contours of rod gripping portions of the socket. The flanged end of the rod element is received in an enlarged portion of the socket to resist axial withdrawal of a rod from a socket in which it is installed. Because of the soft and pliant character of the connector elements, a small child can easily assemble parts to form a structure. Also, there is substantial resilience and flexing ability to the rod-to-connector joint to minimize the likelihood of injury resulting from a small child falling into an assembled structure, for example.

To advantage, certain of the rod elements of the new construction toy set are formed of a somewhat harder and more rigid material than the connector elements, although preferably with sufficient resilience and flexibility to bend if fallen upon during play, for example. Rods also may be provided in a softer, more easily bendable and flexible form to enable a significant degree of shaping of the rods during the assembly of structures with the set components.

For a more complete understanding of the above and other features and advantages of the invention, reference should be made to the following detailed description of preferred embodiments thereof, and to the accompanying drawings.

DESCRIPTION OF THE DRAWINGS

FIG. 3 is a side elevational view of the connector of FIG. 1.

FIG. 4 is an enlarged fragmentary cross sectional view as taken generally on line 4—4 of FIG. 1.

FIG. 5 is an enlarged fragmentary illustration of the encircled portion of FIG. 1.

FIG. 6 is a plan view of a form of connector element according to the invention, provided with five radially spaced rod-engaging sockets.

FIG. 7 is a side elevational view of the connector element of FIG. 6.

FIG. 8 is a cross sectional view as taken generally on line 8—8 of FIG. 6.

FIG. 9 is a plan view of yet another form of connector element according to the invention, provided with four radially spaced sockets.

FIG. 10 is a cross sectional view as taken generally on line 10—10 of FIG. 9.

DESCRIPTION OF PREFERRED EMBODIMENTS OF THE INVENTION

Figure 1:
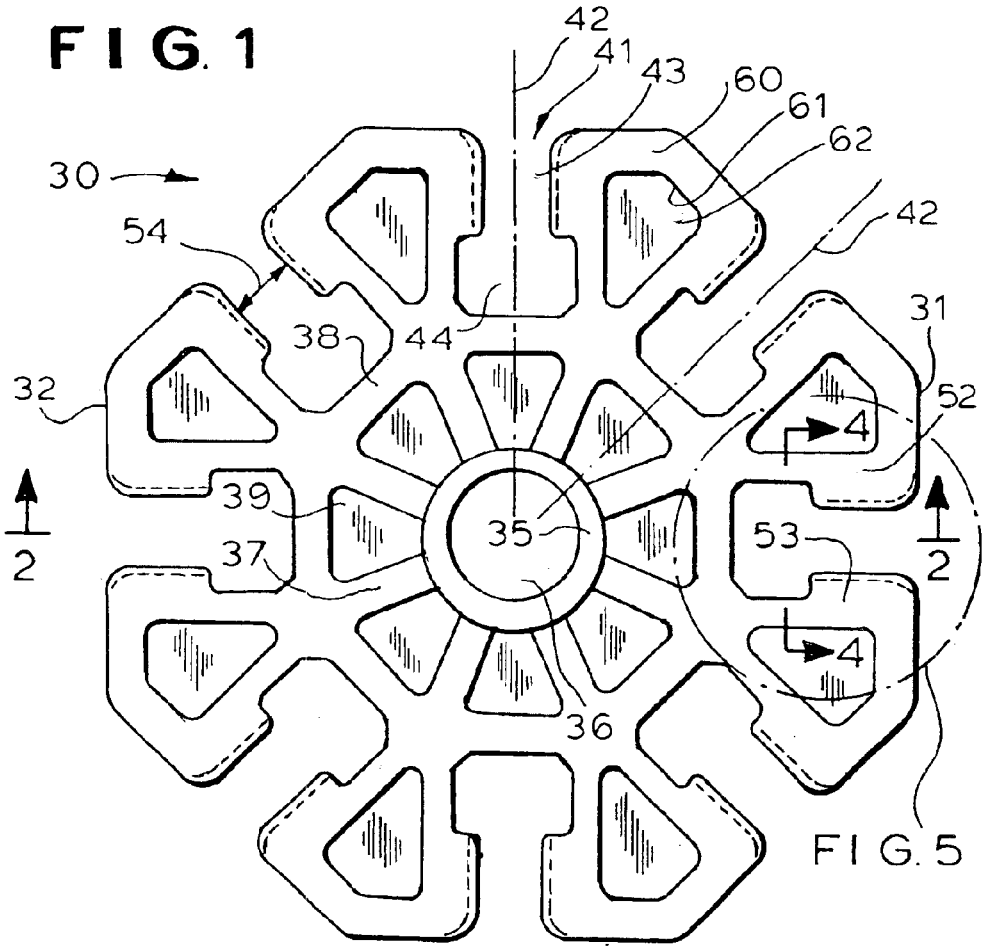
FIG. 1 is a top plan view of an eight socket connector element constructed in accordance with the invention.

Referring now to the drawings, and initially to FIGS. 1–5 thereof, the reference numeral 30 designates generally an eight position connector element, which is injection molded of a soft, pliant plastic material, preferably one having a hardness value of approximately 94 on the Shore A Scale. To particular advantage, the plastic material for the connector element may be a product marketed by DuPont Dow Elastomers under its registered trademark "ENGAGE", Grade 8402. This is a thermoplastic olefin elastomer which is ideally suited for the purposes intended. A related material, marketed by DuPont Dow Elastomers under its trademark "ENGAGE", Grade 8403, has a hardness value of 96 on the Shore A Scale which is somewhat harder than optimum, making it more difficult for small children to assemble and disassemble components of the new construction set. Grade 8401 of the same material, by the same manufacturer, has a hardness value of 85 on the Shore A Scale, which is softer than optimum and easily abraded in the intended environment.

The connector element 30 of FIG. 1 has the general configuration of an octagon and ideally has an overall width between opposed side faces 31, 32 of approximately 2½ inches. An ideal thickness, between the principal front and back faces 33, 34 of the connector is approximately 0.375 inch.

The connector 30 is provided with a central hub 35 which, in the configuration shown in FIGS. 1–5, defines a cylindrical through opening 36. The cylindrical side walls of the hub extend somewhat beyond the front and back faces 33, 34 of the connector, giving the hub an overall axial length of slightly more than ½ inch.

A plurality of spoke-like webs 37 extend radially from the hub 35 and intersect with octagonally arranged intermediate walls 38. The radial webs 37 and intermediate walls 38 define generally triangular spaces 39, which preferably are closed by means of web walls 40 disposed in the central plane of the connector body.

The octagonally arranged intermediate walls 38 form inner ends of each of eight radially spaced rod-engaging sockets 41 defined by the connector. The sockets 41 are arranged on radially disposed axis 42, separated by angles of 45 degrees. The sockets 41 are comprised of rod gripping portions 43 and rod end receiving portions 44, which are specially sized and shaped to receive and grip rods 45 of the type shown in FIG. 13. These rods, which will be described in greater detail, include elongated central body portions 46, of generally cylindrical cross sectional outline, forming the central portion of the rod. At each end, the rods are provided with neck portions 47 of reduced diameter, and end flanges 48 which are preferably and advantageously of the same diameter as the cylindrical outline of the body portion 46.

Pursuant to the invention, the rod-engaging sockets 41 extend completely through the body of the connector 30, from one side to the other, and are open on both sides. Preferably, the rod end receiving portions 44 of the sockets 41 conform very closely in size and shape to the end flanges 48 of the rods 45. Thus, the end flange portion 48 of a rod, while being closely confined within the socket portion 44, can be passed through from one side to the other.

In an advantageous form of the invention, the rods 36 have a basic diameter of approximately 0.375 inch for the body portion 46 and end flanges 48. The end flanges 48 may be approximately ¼ inch in length and are preferably provided with a distinct bevel or chamfer 49 at their outer ends, for example a 1/16 inch bevel at 45 degrees. The inner portions 44 of the connector sockets are shaped and dimensioned to closely conform to the described shape and dimensions of the end flanges 48 of the rods, in order that the end flanges are snugly confined within the socket end portions 44.

The neck portions 47 of the rods 45 advantageously are of cylindrical form and have a diameter of approximately 0.250 inch and, in the preferred embodiment, an axial length of about 0.320 inch between opposed end faces 50, 51 of the end flanges 48 and rod body 46, respectively. As reflected in FIG. 5, for example, a connector socket 41 is defined by opposed side walls 52, 53, inner portions 52*a*, 53*a* of which join with the intermediate walls 38. In the rod gripping portions 43 of the sockets, defined by outer portions 52*b*, 53*b* of the side walls, the minimum spacing between the side wall portions (see 54 in FIG. 5) is considerably less than the diameter of the rod neck portions 47. In a preferred embodiment, the entrance dimension of the rod gripping portion is approximately 0.212 inch. The outer portions 52*b*, 53*b* of the side walls are formed with cylindrical grooves 55, 56 (see FIGS. 4 and 5) which are coaxial with the socket axis 42. The grooves 55, 56 define segments of a cylinder of approximately 0.250 inch diameter. Thus, the neck portion 47 of a rod element 45 may be forced laterally into the rod gripping portion 43 of a socket (from either side). Typically, the axis of the rod is aligned parallel to the axis of the socket, and the rod is pushed laterally into the socket, with the end flange 48 of the rod aligned with the inner socket portion 44. The neck portion 47 of the rod, under lateral pressure applied to the rod, forces apart the opposed side walls 52, 53, which deflect elastically as necessary to allow the neck portion 47 of the rod to enter into the opposed grooves 55, 56. To advantage, the outer side wall portions 52*b*, 53*b* are convergently tapered, as indicated in FIG. 4, to facilitate outward displacement of the side walls 52*b*, 53*b* as a rod is pressed laterally into the socket. When the neck portion of the rod is seated between the opposed grooves 55, 56, the rod is firmly gripped thereby and held in axial alignment with the socket axis 42. The end flange 48 of the rod, received in the inner socket portion 44, locks the rod against axial movement in either direction.

To accommodate easy assembly and disassembly by young children, the forces required for lateral insertion of a rod 45 into a rod gripping socket must not be too great. At the same time, there must be adequate gripping and holding of the rod in the socket 41 to enable a useful structure to be assembled. To this end, it is desirable and advantageous for the cylindrical grooves 55, 56 to be subtended by an angle 57 of between 60 and 70 degrees, and preferably about 64 degrees. With the indicated materials employed for the connector, grooves 55, 56 of this proportion provide adequate holding power without unduly hindering the assembly and disassembly operations by young children.

In a preferred embodiment of the invention, the respective side walls 52, 53 of an adjacent pair of rod-engaging sockets 41 are joined by integral angular outer walls 60, which define the outer peripheral walls of the connector. The walls 52, 53 and 60 define a somewhat triangularly shaped opening 61, which preferably is closed by a central panel 62 preferably disposed in the central plane of the connector body, adding an element of rigidity to the quadrilateral tongue-like elements 63 comprised of side walls 52, 53 and the connecting outer wall 60. As shown in FIG. 1, the tongue-like elements 63 which separate adjacent pairs of rod-receiving sockets 41, are joined with an inner body portion of the connector, defined by the radial walls 37 and the intermediate walls 38.

The peripheral walls 60 serve multiple functions. They provide blunt and soft contact areas to minimize the likelihood of any injury from unintended contact. Additionally, by connecting the rod gripping portion of one socket to a corresponding rod gripping portion of an adjacent socket, each one helps to support the other to some extent, which is desirable in view of the soft and pliant nature of the plastic material employed in the connector.

In the modified socket shown in FIGS. 6–8, the connector is formed with five rod-engaging sockets 41, also radially spaced at angles of 45 degrees. The basic structure and configuration of the sockets 41 and other principal elements of the connector 70 are the same as those of the connector 30 of FIG. 1, except where noted. A principal difference resides in the fact that rod-engaging sockets 71, 72 at the opposite extremities of the connector body have no neighboring sockets on one side. Accordingly, it is advantageous to reinforce the outer side walls 73, 74, forming the outer walls of the sockets 71, 72, by means of a rib 75, which extends along the base wall 76 of the connector, preferably from one side extremity to the other. Thus, whereas the side walls of intermediate sockets are provided with a measure of support from the connected side walls of neighboring sockets, the outer side walls of the sockets at the extremities rely upon the rib 75 for such reinforcement.

Figure 2:
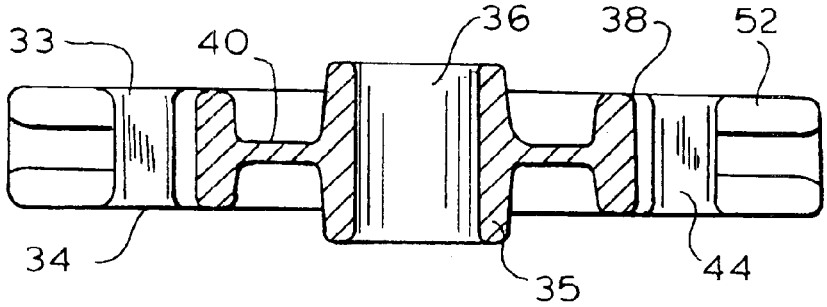
FIG. 2 is a cross sectional view as taken generally on line 2—2 of FIG. 1.

By comparing FIG. 2 and FIG. 8, it will be seen that, in the case of FIG. 2, the hub 35 has a cylindrical passage 36 extending from one axial end thereof to the other. In FIG. 8, by contrast, a hub 77 is formed with a central dividing wall 78 and a plurality of internal annular gripping ribs 79. The through passage 36, as shown in FIG. 2, can be provided in any of the forms of connector. In particular, however, it is desirable to provide through passages in the hubs of at least selected ones of the octagonal connector elements 30 as shown in FIG. 1. Other socket configurations, and certain others of the octagonal sockets can be provided preferentially with blind hub passages provided with a dividing wall 78, as shown in FIG. 8.

Figure 12:
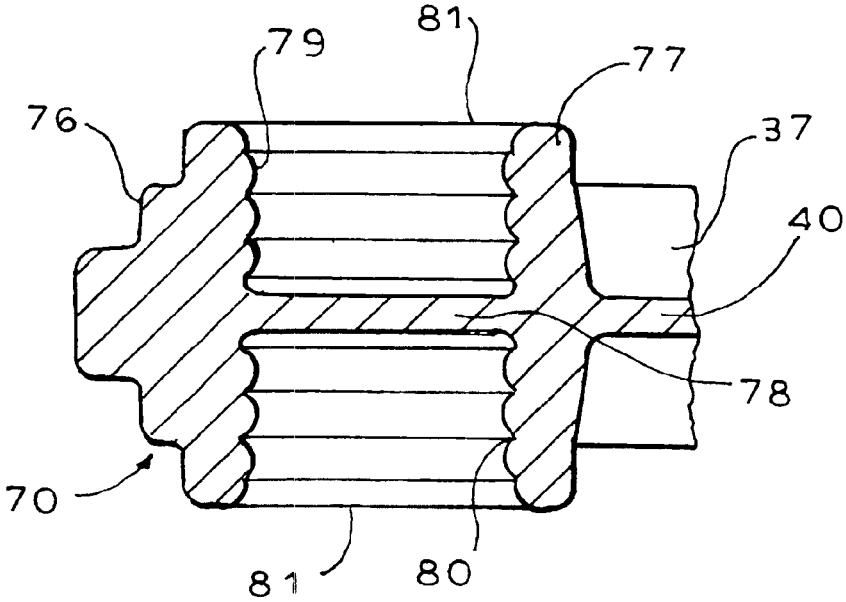
FIG. 12 is an enlarged, fragmentary cross sectional view as taken on line 12—12 of FIG. 8.
Figure 20:
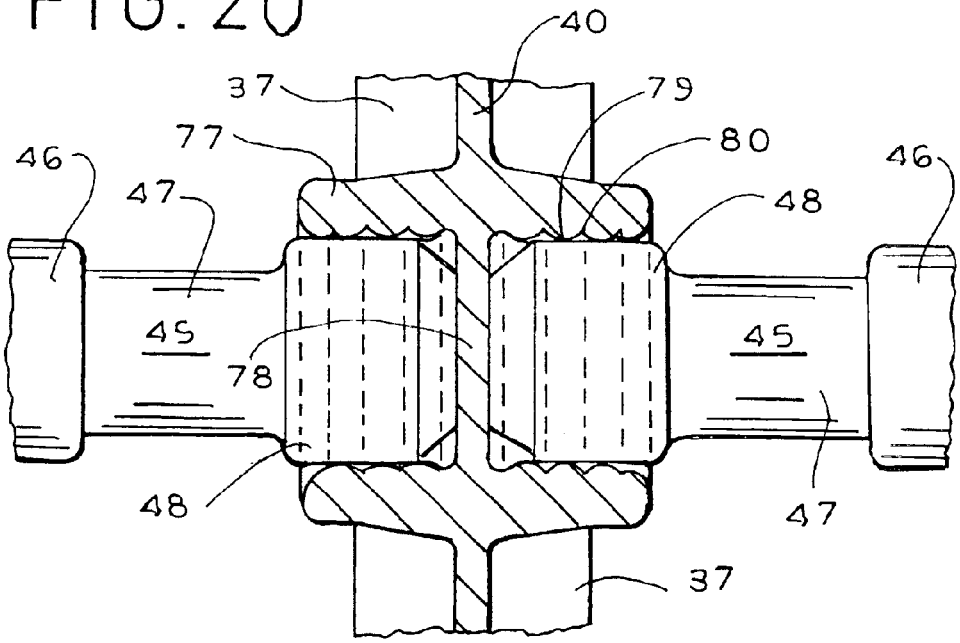
FIG. 20 is a fragmentary cross sectional view, similar to FIG. 19, where the connector hub is formed with a central abutment web and provisions for gripping rod elements by their ends.

With reference now to FIG. 12, the hub 77 is formed with three annular ribs 79 on each side of the central wall 78. The minimum diametral dimension of the annular ribs 79 is slightly less than the diameter of the end flanges 48 of the rods. The root diameter, that is the diameter of the spaces 80 between adjacent ribs 79, advantageously is slightly greater than the diameter of the end flanges 48. Thus, where the end flanges 48 have a diameter of 0.375 inch, the minimum diameter of the ribs 79 suitably may be about 0.370, and the root diameter 80 may advantageously be about 0.380 inch. When a rod end 48 is inserted into the open end 81 of the hub recess, the annular ring 79 are deformed and expanded, and serve to tightly grip the end flange 48, as shown for example in FIG. 20. This arrangement enables both rods and connectors to be "stacked" by inserting rods endwise into the blind hub recesses, as generally shown in FIG. 20 for example.

Figure 11:
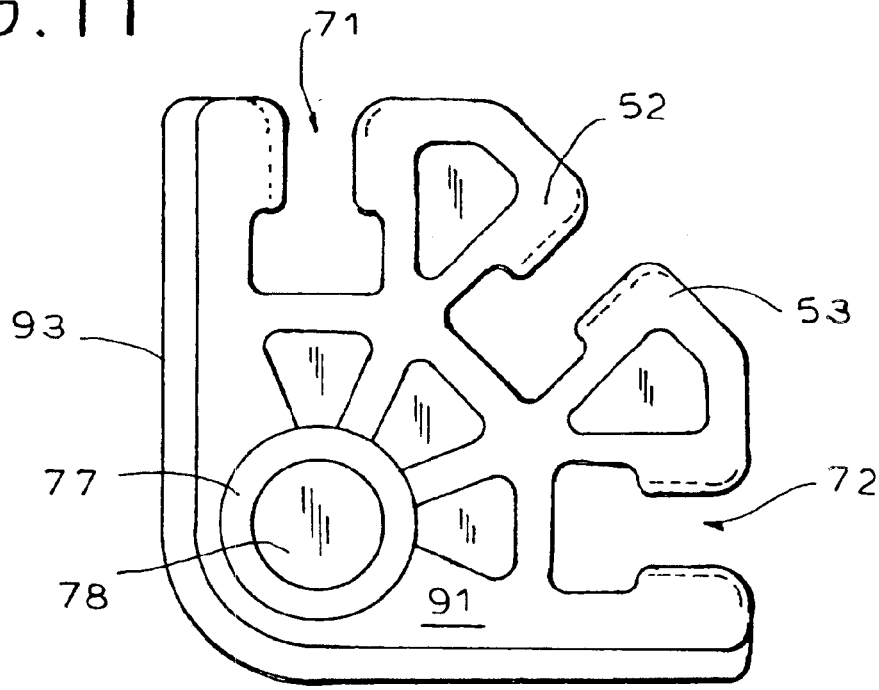
FIG. 11 is a plan view of another form of connector element according to the invention, provided with three radially spaced sockets.

FIGS. 9–11 illustrate additional forms of connector elements 90, 91, formed respectively with four and three rod-engaging sockets each. The construction features of the connector elements 90, 91 are in substance the same as the connector element 70 of FIG. 6, in that the sockets 41 are arrayed at angles of 45 degrees, and in that the sockets 71, 72 at the extremities, are supported on one side by reinforcing ribs 92, 93 functioning in the same manner as the reinforcing rib 75 of FIG. 6. All of the described connector elements are formed of a soft, pliant plastic material such as the previously described thermoplastic olefin elastomer "ENGAGE", grade 8402.

In a preferred embodiment of the invention, the primary rod elements 45 are formed of a harder, stiffer material than that used in forming the various connector elements. To advantage, the primary rod elements may be formed of a general purpose polypropylene, such as that marketed by Himont Incorporated under its registered trademark "PRO-FAX". A material sold as "PRO-FAX" 6331 NW, which has a Rockwell hardness of 105 (R Scale) is suitable. The rods are advantageously molded in a series of lengths based upon a right-triangle configuration. Thus, the rod of each greater length in the series is appropriate for installation along the hypotenuse side of an equilateral right triangle formed using three connectors, where the right angle sides of the triangle are formed by two rods of the next shorter size in the series. The two short sides of the right triangle are made up of the lengths of the shorter rods, plus the distance from the inner ends of the rod-engaging sockets to the center axis of the connector hub. Likewise, the total distance along the hypotenuse side of the right triangle is made up of the lengths of the longer rod, together with the distance from the inner end of the connector sockets to the center of the hubs of the connectors with which the rod is engaged. The shortest of the rods in the series advantageously is of a size to join two connectors side by side, with their outer walls 60 substantially in contact. There is no theoretical limit to the maximum length of rods in the series. However, as a practical matter, a rod of about 8.7 inches in overall length is a suitable maximum for a typical toy construction set.

Figure 14:
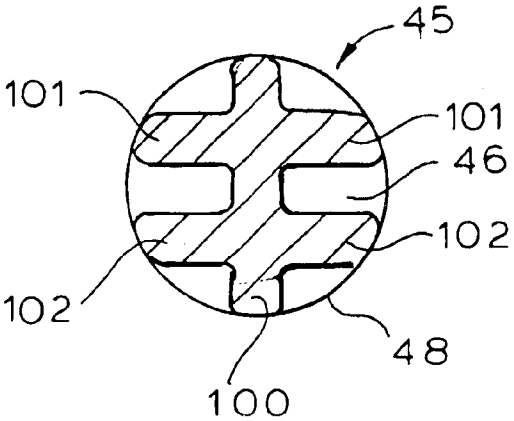
FIG. 14 is a cross sectional view as taken generally on line 14—14 of FIG. 13.

Preferably, the body portions 46 of the rods 45 are not formed as solid cylinders, as such is not needed for strength and adds unnecessarily to weight and cost. Preferably, the body portions 46 are of a ribbed configuration, as reflected in FIG. 14 of the drawings. A central web 100 extends along a diameter of the rod body, from one side to the other. Ribs 101, 102 extend from the central web, at right angles thereto and in spaced apart relation. The web 100 and ribs 101, 102, at their outer extremities, define a cylindrical envelope which corresponds to the cylindrical outer surfaces of the end flanges 48.

Figure 13:
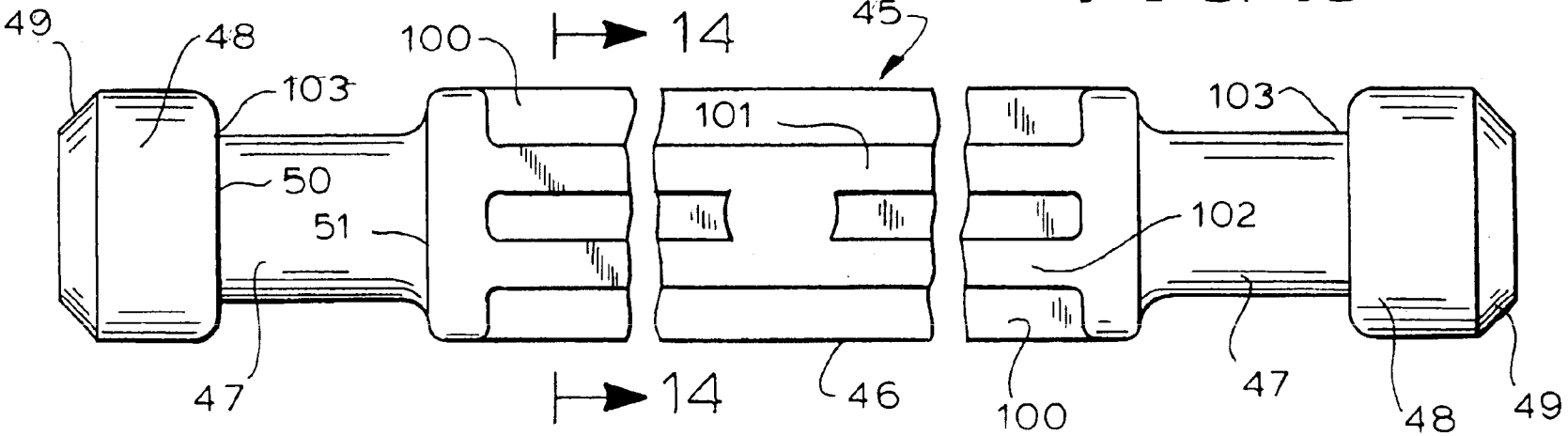
FIG. 13 is an elevational view of a typical rod element of the construction set of the invention.

As indicated in FIG. 13, the neck portions 47 of the rods advantageously are formed with relatively sharp corners 103, where the neck portions join with the inner surfaces 50 of the end flanges 48. At their opposite ends, the neck portions merge into the end surfaces 51 of the rod body 45 with a generously rounded fillet of, for example, 0.04 inch radius.

Figure 17:
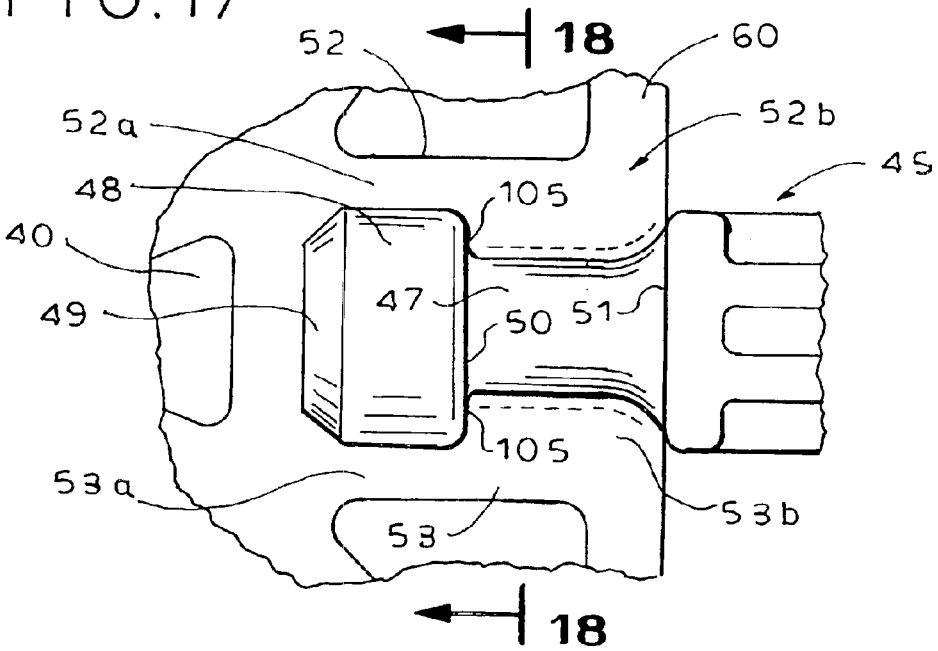
FIG. 17 is an enlarged, fragmentary view illustrating the manner in which a rod and connector socket are joined, with the rod disposed in coaxial relation with the axis of the socket.

The configuration of the end portions of the rods 45 preferably conforms closely to that of the connector sockets 41. The neck portions 47 are formed with a length of approximately 0.320 inch between the end faces 50, 51, and substantially the same dimension is used for the length of the rod gripping portions 43, between internal shoulders 105 of the socket and the outer side face 31 of the connector, as shown in FIG. 17. This helps to provide a snug and secure fit and connection of the rod to the connector.

As shown in FIG. 4, the lateral entry surfaces 104 convergently taper toward the cylindrical contoured gripping surfaces 55, 56 to facilitate lateral entry of the rod throat 47 into a gripping position. In a preferred embodiment of the invention, an opposed pair of the surfaces 104 may be disposed symmetrically, at angles to each other of about 22 degrees.

Although it is contemplated that assembly and disassembly of rods to connectors will take place by lateral movement of a rod end into and out of a rod-gripping socket 41, it is also recognized that, because of the soft and pliant nature of the material of which the connectors are formed, and the relatively undisciplined nature of the young children expected to be using the toy set, that rods may be forcible detached from connectors in other ways. For example, a connector may be held stationary, while a rod joined to it is forcibly displaced by its outer end, in the same plane as the connector. If enough force is applied in this manner, the connector socket 41 will be forced open and one side of the rod end 48 will be forcibly displaced beyond its retaining shoulder 105, allowing the rod to be forcibly extracted out through the open front end of the socket 41. With the rod and socket configuration of the illustrated embodiment, this can be accommodated with minimum damage to the connector element, by reason of the contours of the rod end 48 and of the end portion 44 of the socket. Thus, the generously rounded inner edges 106 of the rods 45 enable a skewed rod to slide past the shoulder 105, when necessary, without causing excessive abrasion of the soft plastic material. The inner corner edges 105*a* of the shoulders 105 preferably are also slightly rounded, for example on a 1/32nd inch radius. In addition, the beveled outer front edges 49 of the rod end 48 also facilitate withdrawal of a skewed rod from the socket 41 without excessive abrasion. This is advantageous in that it enables the use of soft pliant materials for the connector elements both for safety and for easy manipulation by immature hands, without resulting in accelerated wear of the connectors.

Figure 15:
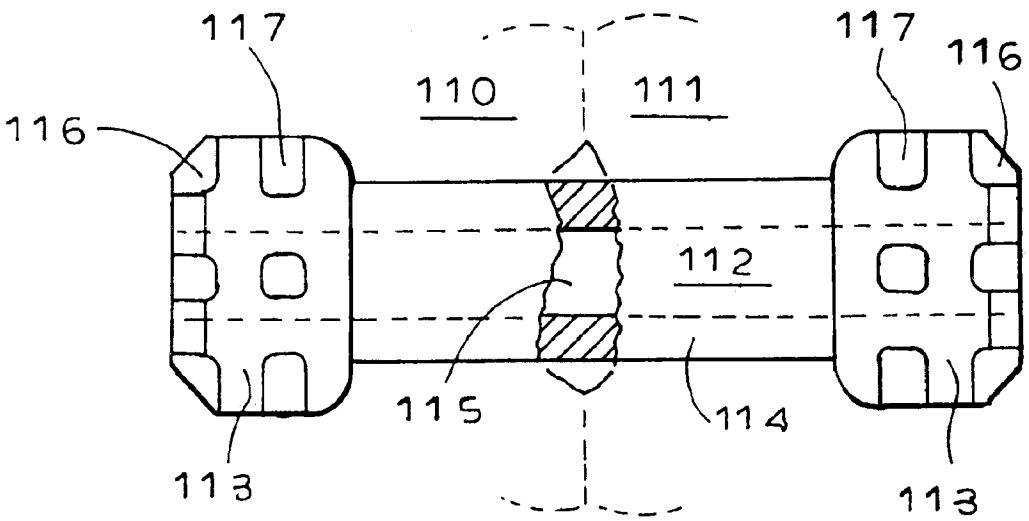
FIG. 15 is an elevational view, with parts broken away, of a special short length rod element utilized to advantage in the construction set of the invention.
Figure 16:
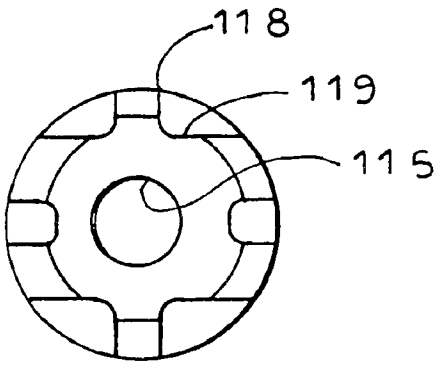
FIG. 16 is an end elevational view of the rod of FIG. 15.
Figure 18:
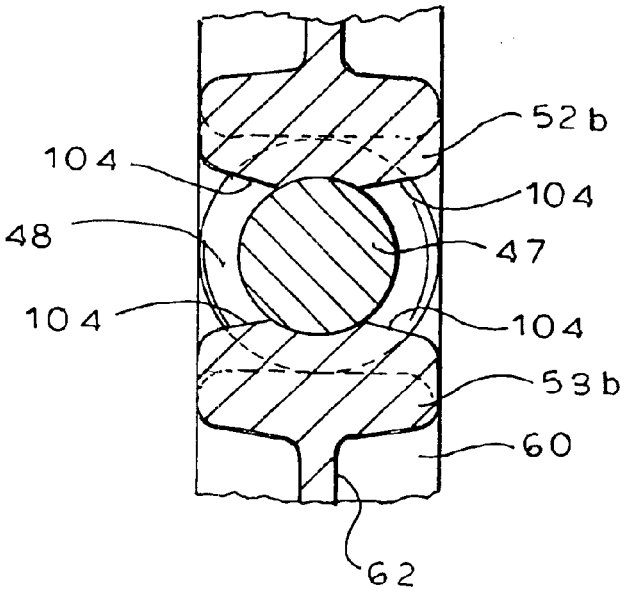
FIG. 18 is a fragmentary cross sectional view as taken generally on line 18—18 of FIG. 17.

In an advantageous form of construction toy set according to the invention, the shortest rod of a series thereof, based upon a right triangle progression as previously described, is of a size, as reflected in FIG. 15, that will engage two connector elements 110, 111 lying in the same plane, with their outer surface portions substantially in abutting relation. To this end, the shortest rod 112, shown in FIG. 15, is comprised of a pair of opposite rod ends 113 connected by a cylindrical section 114 of uniform diameter, the length of which corresponds generally to the length of two neck portions 47 of the longer rod elements 45, as shown in FIG. 13. In a toy construction set of the general dimensions heretofore referred to, the overall length of the short rod 112 is approximately 1.170 inch.

As a safety feature, the rod 112 of FIG. 15 is provided at its opposite ends 113 with a plurality of outwardly facing recesses 116, 117 which form numerous corners and edges 118, 119 around the opposite end edges of the rod. The purpose of these corners and edges is to provide an irritant in the event that a rod were to be placed in a child's mouth. In such a case if the corners and/or edges 118, 119 were to come into contact with areas near the throat or windpipe, it hopefully would induce a gag reflex, resulting in the rod being rejected and removed before a problem arose.

Figure 19:
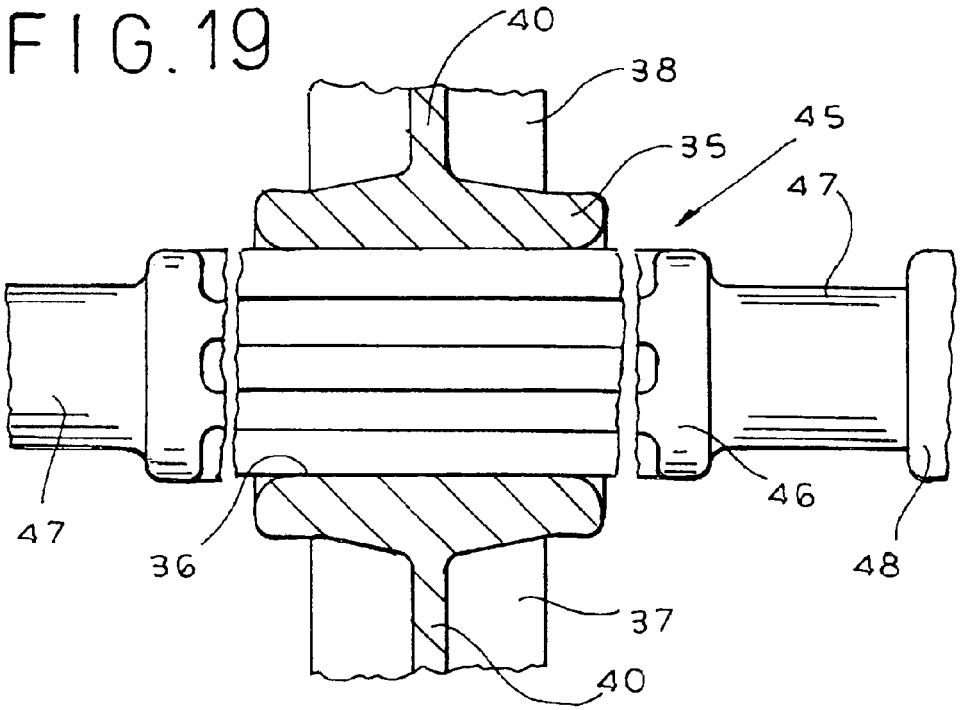
FIG. 19 is a fragmentary cross sectional view of a socket provided with a hub with a central opening extending therethrough, illustrating a rod element disposed within the hub.

To advantage, it may be desirable to provide that certain of the rod elements of the construction set, particularly some of those of greater length, be of a relatively flexible, bendable nature. This allows flexible rods to be incorporated into structures in a variety of shapes and contours. To this end, selected ones of the longer rods advantageously may be molded of a relatively soft, flexible material such as Monprene MP 1805 as made available by QST, Inc., St. Albans Vt. The indicated material, which has a hardness of about 90 on the Shore "A" scale, is slightly softer than the material of which the connector elements are formed, and thus allows a rod to be easily bent into various shapes. The basic cross section and outer configuration of the bendable rods is the same as the rods made of the harder, polypropylene material, as regards the rod ends, neck portions and body portions, and the softer rods will in all respects function in the same manner as the harder and stiffer rods, except that they are bendable. In a typical construction toy set according to the invention, some of at least the longest (e.g., 8.7 inch) rods preferably are formed of the Monprene MP material As reflected in FIGS. 19 and 20, the different types of hub structures provided in the connector elements allow different functions to be performed, depending on the desires of the builder. In FIG. 19, for example, the connector 30 has a hub 35 formed with a smooth cylindrical opening 36 extending completely through the hub. A rod 45 can be passed through the opening 36, and the central body portion 46 of the rod is rotatable within, or rotatably supports, the connector element. The rod will also be slideable within the hub as will be appreciated.

In the arrangement shown in FIG. 20, the hub 77 is formed with a central dividing wall 78 defining opposed blind recesses 77*a*. The ends 48 of one or two rods 45 can be inserted into the blind recesses and are tightly gripped therein by means of the annular ribs 79. Preferably, the depth of the blind recesses is approximately 0.250 inch, approximately the same as the axial length of the rod end portions 48, so that the rod ends are fully received in and gripped by the hub recesses 77*a*. This structure provides a great deal of flexibility of the design of toy structures that can be built with the new construction set and, among other things, allows connector elements to be connected together in laterally spaced apart relation.

Figure 22:
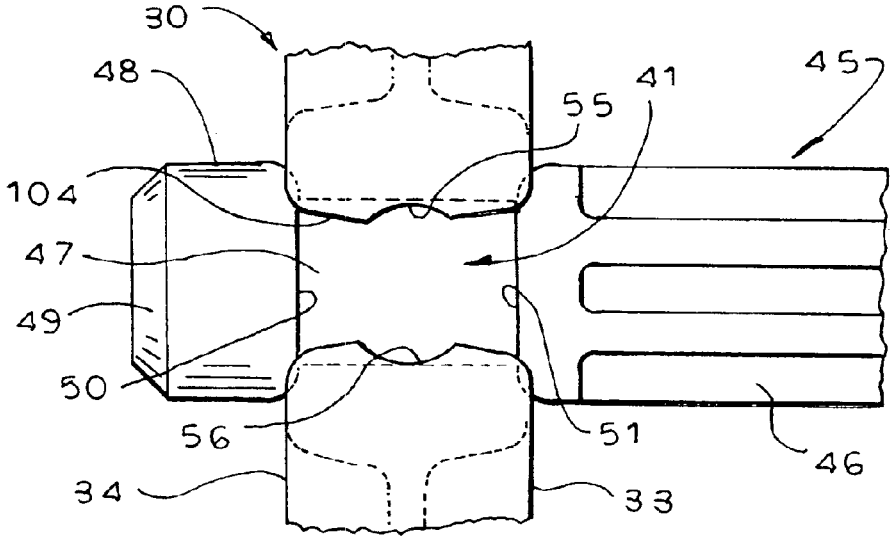
FIG. 22 is a fragmentary cross sectional view as taken generally on line 22—22 of FIG. 21.
Figure 21:
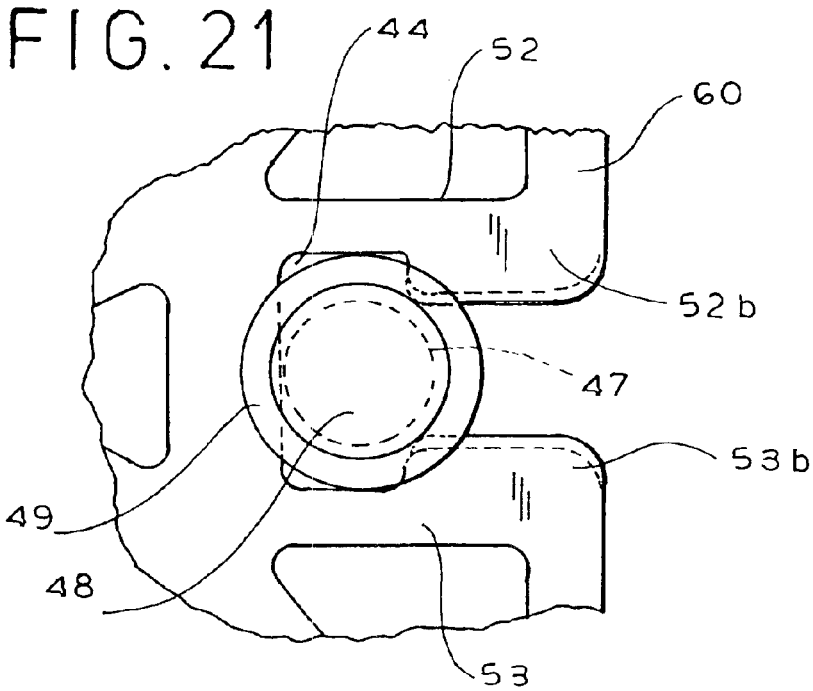
FIG. 21 is a fragmentary elevational view illustrating the manner in which rod elements are engaged with connector sockets, with the rod and socket axis at right angles.

FIGS. 21, 22 of the drawings illustrate an alternative arrangement for assembling rods 45 to connectors 30 (or 70, 90, 91) at right angles to the plane of the connector. This is accomplished by disposing the rod at right angles to the connector and pushing the neck portion 47 of the rod into the open outer end of a connector socket 41. The diameter of the neck portion 47 (approximately 0.0250) is somewhat greater than the socket opening defined by the outer socket walls 52*b*, 53*b* (approximately 0.212 inch) so that the crosswise insertion of the rod neck 47 into the socket requires the socket to be forced open to a certain extent, which is accommodated by lateral flexing of the tongue-like elements 63.

The rod 45 is pushed into the socket 41 until the neck portion 47 reaches the enlarged rod end receiving portion 44 of the socket (FIG. 21). The socket side walls 52, 53 then resiliently close to their normal positions to retain the neck portion 47 within the socket portion 44.

In a particularly preferred embodiment of the invention, the axial length of the neck portion 47 is slightly less than the thickness of the connector 30, between its side faces 33, 34. For example, the thickness of the connector 30 may be approximately 0.375 inch while the axial length of the neck portion 47 may be approximately 0.320. Accordingly, when the neck portion 47 is pressed into the socket 41, in the perpendicular orientation illustrated in FIG. 22, the shoulders 50, 51 at opposite ends of the neck portion 47 will engage and compress inwardly the side walls 33, 34 of the connector, in areas where surfaces of the shoulders 50, 51 confront surfaces 33, 34 of the connector. This provides for a desired snug fit of the rod and connector when assembled in the illustrated manner.

To particular advantage, the cylindrical neck portion 114 of the short rod 112 has an overall length of about 0.670, which is slightly less than the thickness of two connector elements placed side by side. Accordingly, the shortest rod 112 also can be installed crosswise in the sockets of a pair of side by side connector elements to join them together in that configuration.

The toy construction set of the invention is particularly well suited for use by young children whose manual dexterity and finger strength has not been well developed. Particularly important is the relatively large size of the connector elements and rods, which enables them to be easily gripped and manipulated by small hands, in conjunction with the soft and pliant nature of the connector element, which enable small hands to easily assemble and disassemble the parts. The component parts of the new toy set, while bearing a family resemblance to the well known K'nex® construction sets, and incorporating many of the advantageous features thereof, also differs therefrom in significant ways. One of those is relative softness of the connector material in relation to the harder material of the rods. Another resides in the fact that the rod-gripping portions of the connector sockets engage and grip the neck portions of the rods to hold the rods in axial alignment with the rod-engaging sockets. Rods are held in crosswise engagement with the connectors is different ways, either by inserting the neck portions of the rods crosswise into the connector sockets, or by inserting the flanged rod ends into blind recesses in connectors provided with such.

The soft and pliant nature of the connector elements is an important safety feature as well, as it allows installed rods to be deflected upon unintended contact. It also allows a rod, installed by lateral insertion into a rod gripping socket, to be removed by a twisting motion in the plane of the connector. Even though it is not intended that a rod be removed in this fashion, it is recognized that immature children may frequently work with the parts in unintended ways, and the construction set of the invention accommodates such behavior.

The relatively large size of the component parts is in itself a safety feature in that small, immature children are unlikely to place the larger parts in their mouths. Were they to do so, there is little likelihood that any injury would be caused. An additional, safety feature is incorporated into the smaller size rods to minimize possible accidental choking hazards, by increasing the likelihood that the part would be rejected by a gag reflex.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A rod and connector toy construction set, especially for young children, which comprises (a) a plurality of rods molded of plastic material, each having a rod axis, and comprising a body portion, a neck portion having one end thereof adjoining said body portion, and a rod end adjoining said neck portion at an end thereof opposite from said one end, (i) said neck portion having a transverse dimension perpendicular to said rod axis which is less than corresponding transverse dimensions of said rod end, (ii) a shoulder being formed between said rod end and said neck portion, and (b) a plurality of connector elements each comprising (i) a connector body formed of a soft and pliable plastic material and having front and back sides and a peripheral edge, (ii) said connector body having a rod-engaging socket therein extending through said connector body from one of said sides thereof to the other of said sides and defined by elements of said connector body, (iii) said socket having a gripping portion of a first predetermined width, with one end thereof opening at the peripheral edge of said connector body, for gripping the neck portion of said rods, (iv) said socket further having a rod end receiving portion adjoining a second end of said gripping portion, said rod end receiving portion being of a second predetermined width greater than said first predetermined width and forming a shoulder portion adjacent the second end of said gripping portion, (v) said socket defining a socket axis positioned in a plane between the front and back sides of said connector body and extending midway between opposite sides of said gripping portion, (vi) said gripping portion and said neck portion having complimentary contours to enable retention of a rod coaxially with said socket axis, (c) the transverse dimension of the neck portion of said rod being greater than said first predetermined width of said gripping portion, whereby said neck portion may be forced laterally into said gripping portion with a snap-in action and thereafter resiliently gripped by said connector elements with said rod axis in coaxial alignment with said socket axis, and (d) said shoulder portion formed between said neck portion and said rod end being engageable with confronting surfaces of the shoulder portion of said socket to resist axial withdrawal of said rod from said rod-engaging socket.

2. A toy construction set according to claim 1, wherein (a) at least certain ones of said rods have body portions of larger transverse dimension than the neck portion thereof.

3. A toy construction set according to claim 1, wherein (a) said connector elements are formed of a thermoplastic olefin elastomer, (b) said rods being formed of a material of greater hardness than said thermoplastic olefin elastomer.

4. A toy construction set according to claim 3, wherein (a) said thermoplastic olefin elastomer has a hardness less than 96 on a Shore A Scale and greater than 85 on a Shore A Scale, and preferentially about 94 on a Shore A Scale.

5. A toy construction set according to claim 3, wherein (a) at least certain ones of said rods are formed of polypropylene and are relatively rigid, and (b) at least certain others of said rods are formed of a material substantially softer than polypropylene and are relatively flexible in relation to said certain ones of said rods.

6. A toy construction set according to claim 1, wherein (a) said connector body is formed with a cylindrical recess having a recess axis oriented at right angles to said front and back sides, and (b) said cylindrical recess is dimensioned to receive a rod end.

7. A toy construction set according to claim 6, wherein (a) said cylindrical recess extends entirely through said connector body, and (b) said cylindrical recess is dimensioned and adapted to closely receive said rod for rotation within said recess.

8. A toy construction set according to claim 6, wherein (a) said recess axis intersects with said socket axis at right angles thereto, and (b) said connector body is formed with a plurality of rod-engaging sockets in an angular array, each such socket defining a socket axis intersecting with said recess axis.

9. A toy construction set according to claim 6, wherein (a) said cylindrical recess is closed at one end, and (b) said recess is dimensioned to tightly receive and retain a rod end.

10. A toy construction set according to claim 9, wherein (a) said connector body is formed with opposed cylindrical recesses, each closed at one end by a common wall.

11. A toy construction set according to claim 1, wherein (a) the body portion of said rod has a transverse dimension greater than the transverse dimension of said neck portion, (b) said connector body has a predetermined thickness in areas of said rod-engaging socket, and (c) said neck portion having a length, between said rod end and said body portion such, in relation to the predetermined thickness of said connector body, as to enable the neck portion of a rod to be inserted crosswise into said socket with the axis of said rod oriented at right angles to the axis of said socket.

12. A toy construction set according to claim 11, wherein (a) the length of said neck portion is slightly less than the predetermined thickness of said connector body, whereby the material of said connector body, in regions adjacent to said socket, is compressed upon crosswise insertion of said neck portion into said socket.

13. A toy construction set according to claim 1, wherein (a) a plurality of rods are provided in graduated lengths, (b) a shortest one of said rods having a rod end at each end thereof and an elongated neck portion extending between said rod ends, (c) said elongated neck portion having a length slightly less than twice a thickness dimension of said connector body, whereby said rods may be inserted crosswise in sockets of two connector elements positioned side by side.

14. A rod and connector toy construction set, especially for young children, which comprises (a) a plurality of rods molded of plastic material, each having a rod axis, and comprising a body portion having opposite ends, neck portions having one end thereof adjoining each end of said body portion, and a rod end adjoining each of said neck portions at an end thereof opposite from said one end, (i) said neck portions having a transverse dimension perpendicular to said rod axis which is less than corresponding transverse dimensions of said rod end and said body portion, (ii) shoulders being formed between each said rod end and an adjacent neck portion, and between each end of said body portion and an adjacent neck portion, (b) a plurality of connector elements each comprising (i) a generally flat connector body formed of a plastic material which is soft and pliable in comparison to the material of said rods and having front and back sides and a peripheral edge, (ii) said connector body having one or more rod-engaging sockets therein extending through said connector body from one of said sides thereof to the other of said sides and defined by elements of said connector body, (iii) said sockets each having a gripping portion of a first predetermined width, with one end thereof opening at the peripheral edge of said connector body, for gripping a neck portion of a rod, (iv) said sockets each defining a socket axis positioned in a plane between the front and back sides of said connector body and extending midway between opposite sides of said gripping portion, (v) said gripping portion and said neck portion having complimentary contours to enable retention of a rod coaxially with said socket axis, (c) the transverse dimension of portions of said neck portion being greater than said first predetermined width of said gripping portion, whereby said neck portion may be forced laterally into said gripping portion with a snap-in action and thereafter resiliently gripped by said connector elements with said rod axis in coaxial alignment with said socket axis, and (d) interengaging shoulders on said rods and said sockets to resist axial withdrawal of said rods from said rod-engaging sockets.

15. A toy construction set according to claim 14, wherein (a) said connector elements are formed with a recess therein aligned along a recess axis disposed at right angles to said socket axes, (b) said recess being adapted to receive a rod end of a rod aligned with said recess axis.

16. A toy construction set according to claim 15, wherein (a) said recess has a bottom wall and is of a size to snuggly receive and grip said rod end.

17. A toy construction set according to claim 15, wherein (a) said recess extends through said connector elements and is of a size to loosely receive the end and body portion of a rod to accommodate rotation of said rod relative to said connector elements.

18. A rod and connector toy construction set, especially for young children, which comprises (a) a plurality of rods molded of plastic material, each having a rod axis, and comprising a body portion having opposite ends, neck portions having one end thereof adjoining each end of said body portion, and a rod end adjoining each of said neck portions at an end thereof opposite from said one end, (i) said neck portions having a transverse dimension perpendicular to said rod axis which is less than corresponding transverse dimensions of said rod end, (ii) shoulders being formed between each said rod end and an adjacent neck portion, (b) a plurality of connector elements each comprising (i) a generally flat connector body formed of a plastic material which is soft and pliable in comparison to the material of said rods and having front and back sides and a peripheral edge, (ii) said connector body having one or more rod-engaging sockets therein extending through said connector body from one of said sides thereof to the other of said sides and defined by elements of said connector body, (iii) said sockets each having one end thereof opening at the peripheral edge of said connector body, (iv) said sockets each defining a socket axis positioned in a plane between the front and back sides of said connector body and extending midway between opposite sides of said sockets, (v) said sockets having gripping portions engaging at least one of said rod end or neck portions of said rods, (vi) said gripping portions of said sockets having contours complimentary to portions of said rods engaged by said gripping portions to enable retention of a rod coaxially with said sockets axis, (c) portions of said rod gripped by said sockets having transverse dimensions greater than the gripping portions of said socket, whereby said rod may be forced laterally into said gripping portions with a snap-in action and thereafter resiliently gripped by said connector elements with said rod axis in coaxial alignment with said socket axis, and (d) interengaging shoulders on said rods and said sockets to resist axial withdrawal of said rods from said rod-engaging sockets.

19. A toy construction set according to claim 18, wherein (a) the body portion of said rods has transverse dimensions perpendicular to said rod axis which are greater than transverse dimensions of said neck portions.

* * * * *